US006460732B1

(12) United States Patent
Drennow

(10) Patent No.: US 6,460,732 B1
(45) Date of Patent: Oct. 8, 2002

(54) DEVICE FOR OPENING AND CLOSING CONTAINERS HAVING FLEXIBLE WALLS

(75) Inventor: Sten Drennow, Lund (SE)

(73) Assignee: Asept International AB, Lund (SE)

( * ) Notice: Subject to any disclaimer, the term of this patent is extended or adjusted under 35 U.S.C. 154(b) by 0 days.

(21) Appl. No.: 10/001,540

(22) Filed: Nov. 15, 2001

(51) Int. Cl.[7] ..... B67D 83/00
(52) U.S. Cl. ..... 222/83; 222/107
(58) Field of Search ..... 222/83, 107, 90

(56) References Cited

U.S. PATENT DOCUMENTS 4,257,535 A * 3/1981 Mellett ..... 222/83
4,603,793 A 8/1986 Stern
4,776,488 A 10/1988 Gurzan
6,082,584 A * 7/2000 Stern ..... 222/107

* cited by examiner

*Primary Examiner*—Philippe Derakshani
(74) *Attorney, Agent, or Firm*—Tarolli, Sundheim, Covell, Tummino & Szabo L.L.P.

(57) ABSTRACT

The present invention relates to a device for opening and closing containers having flexible walls and containing a liquid or semi-liquid product, preferably foodstuff such as e.g. ketchup, mustard, dressing, mayonnaise or similar. The container (1) comprises an inner coupling member (4) which is located on the inner side of a sealed or closed portion of the flexible walls (2). A tube member (12) includes a hole-making and coupling member (13) which is pressed through the closed portion of the flexible walls (2) and connected to the inner coupling member (4). The tube member (12) further includes a sealable member (14) which is adapted to be sealed or closed by means of a sealing or closing means (16) such that a container (1) opened by the tube member (12) can be closed again. The sealing or closing means (16) is connected with the tube member (12) or with a member (17) associated therewith.

14 Claims, 2 Drawing Sheets

DEVICE FOR OPENING AND CLOSING CONTAINERS HAVING FLEXIBLE WALLS

Background of the Invention

The present invention relates to a device for opening and closing containers having flexible walls and containing a liquid or semi-liquid product, preferably foodstuff such as e.g. ketchup, mustard, dressing, mayonnaise or similar, said container comprising an inner coupling member which is located on the inner side of a sealed or closed portion of the flexible walls and said device comprising a tube member including a hole-making and coupling member which is adapted to be pressed through the closed portion of the flexible walls for opening thereof as well as adapted to be pressed on to said inner coupling member such that said tube member is fixedly attached thereto and the product can be discharged or fed out of the container through the tube member.

Opening devices for opening containers having flexible walls such that liquid or semi-liquid products can be discharged therefrom, are previously known from U.S. Pat. No. 603 793 and U.S. Pat. No. 4 776 488.

At the prior art opening devices however, the hole-making and coupling member can not be closed when the container has been opened therewith, but it is only adapted for opening the container and permit discharge or outfeed of the product from the container.

BRIEF SUMMARY OF THE INVENTION

The object of the present invention has been to eliminate this problem by means of a simple device and this is arrived at according to the invention by providing said device with the characterizing features of subsequent claim 1.

Since the device is provided with said characterizing features, it is achieved that the container can be opened with the tube member and then closed with a sealing or closing means such that it need not be left open when a portion of the product has been discharged or fed out of said container. It is also achieved that the tube member and sealing or closing means is a one part member.

BRIEF DESCRIPTION OF THE DRAWINGS

The invention will be further described below with reference to the accompanying drawings, in which.

DETAILED DESCRIPTION OF THE INVENTION

Figure 1:
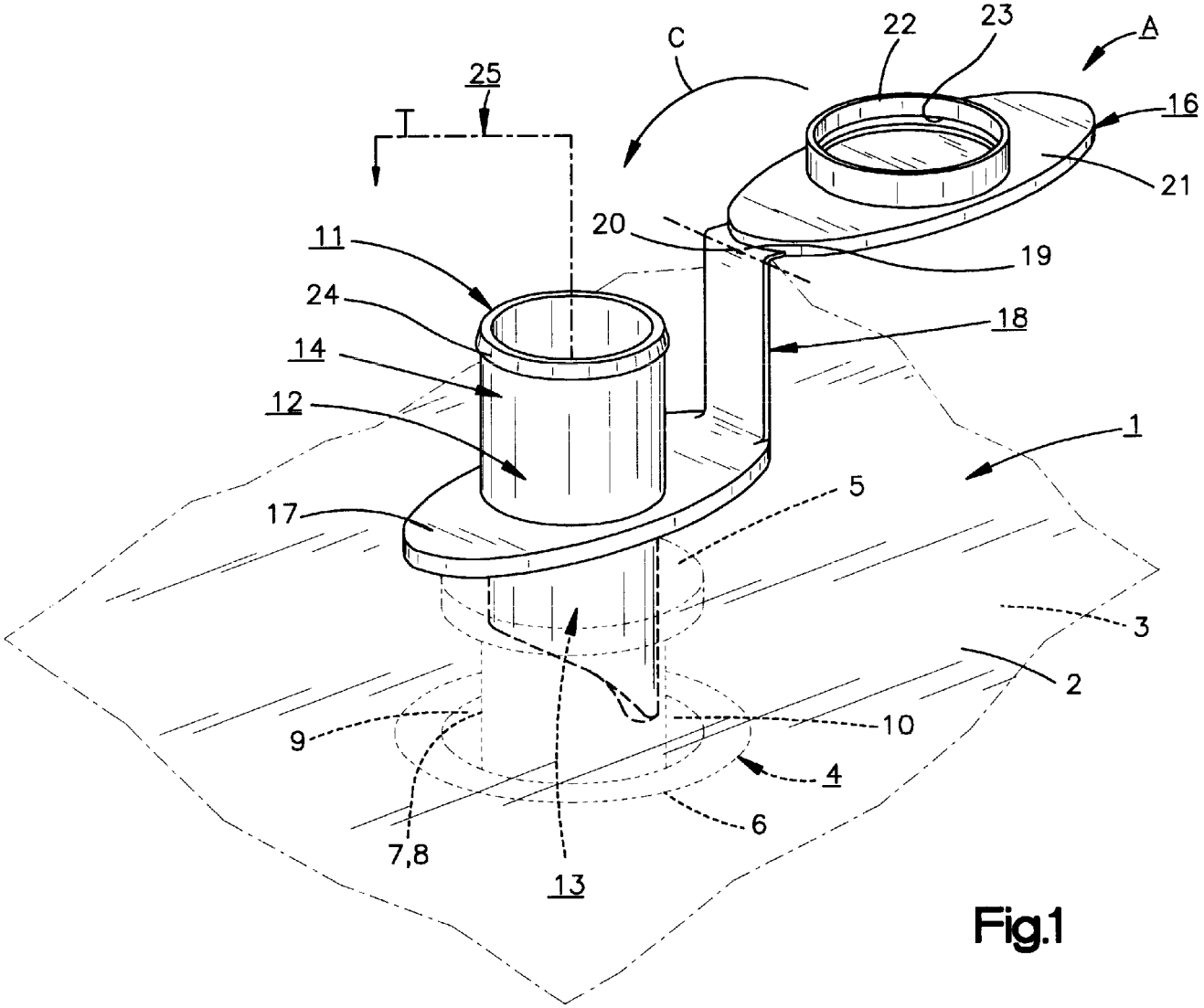
FIG. 1 is a perspective view of a device according to the invention in open condition and connected to a container.

The drawings illustrate a container 1 with flexible walls 2. This container 1 contains a liquid or semi-liquid product 3, preferably foodstuff such as e.g. ketchup, mustard, dressing, mayonnaise or similar.

The container 1 includes an inner coupling member 4 which may consist of an outer ring 5 through which it is fixedly attached to the inner side of a closed portion of the flexible walls 2. The inner coupling member 4 further includes an inner ring 6 which preferably has a somewhat larger outer diameter than the outer ring 5. The rings 5, 6 are connected with each other through at least two connecting members 7, 8 between which there are openings 9, 10.

A device 11 for opening and closing the container 1 comprises a tube member 12 of which a first end portion is designed as a hole-making and coupling member 13, and of which a second end portion has a sealable member 14. The hole-making and coupling member 13 is adapted to be pressed through, to penetrate, the closed portion of the flexible walls 2 for opening said closed portion such that the product 3 can be discharged or fed out through the tube member 12. The hole-making and coupling member 13 is also adapted to be pressed on to the inner coupling member 4 such that the tube member 12 is attached to said inner coupling member 4 and has a direct contact therewith or indirect contact therewith through inwardly folded portions of the flexible walls 2. At the embodiment shown, the hole-making and coupling member 13 may be inserted into a hole 15 in the outer ring 5 and pressed on to said outer ring 5. The sealable member 14 can be sealed or closed by means of a sealing or closing means 16, such that the container 1 can be closed again.

At the illustrated embodiment, the tube member 12 has a transverse collar or a corresponding member 17 which determines how far into the inner coupling member 4 the hole-making and coupling member 13 can be inserted. On the collar 17 there is provided a retaining member 18 which extends in axial direction relative to the tube member 12 and which after a hinge or joint 19 is directed radially outwards relative to said tube member 12. The joint 19 can be a weakened portion of the retaining member 18 or a corresponding member. The sealing or closing means 16 is located on an outer end of the retaining member 18, which holds said sealing or closing means 16 in a rest position A. In this position the retaining member 18 may hold the sealing or closing means 16 in a radially outwardly directed position relative to the tube member 12.

Figure 2:
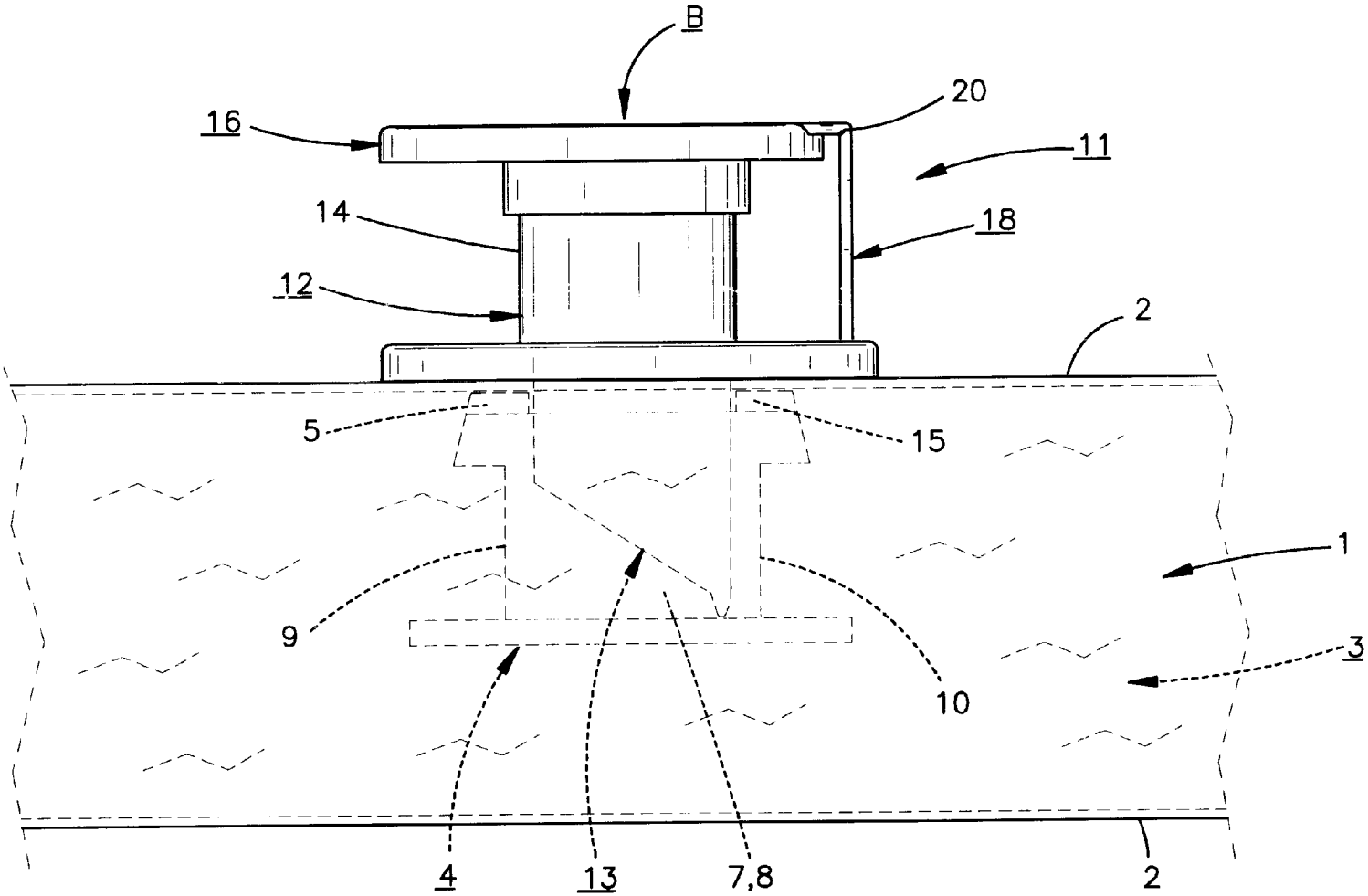
FIG. 2 is a side view of the device according to FIG. 1 in closed condition.

The sealing or closing means 16 is movable from the rest position A to a sealing or closing position B (see FIG. 2) in which it closes or seals the sealable member 14. This movement of the sealing or closing means 16 may occur by manually swinging or pivoting said sealing or closing means 16 about a pivot axis 20 of the joint 19 in an inwardly direction according to arrow C. The joint 19 is preferably provided such that it during swinging or pivoting of the sealing or closing means 16 from the rest position A towards the sealable member 14, guides the sealing or closing means 16 towards the sealing or closing position B.

The sealing or closing means 16 may include a pressure plate 21 and a snap-in member 22 which is provided on an inner side thereof. The snap-in member 22 is adapted to be pressed over the sealable member 14 and it has an inner snap-in portion 23 which can be attached by a snap-in closure to a corresponding external snap-in portion 24 on the sealable member 14. This snap-in closure can be obtained by pressing with the thumb on the outer side of the pressure plate 21.

The sealable member 14, i.e. the tube member 12, may be reopened by removing the sealing or closing means 16 and let it swing or pivot back in opposite direction as arrow C to the rest position A, whereby it is once again possible to discharge or feed product 3 out of the container 1. This can be done by squeezing or compressing the container 1 and is repeated until the container 1 is completely empty.

The tube member 12 and the sealing or closing means 16 may be manufactured in one piece, e.g. of polypropylene material.

The device 11 of the abovementioned type is one of many different possible embodiments within the scope of the subsequent claims. Thus, the tube member 12 is a member with a through hole and said member may be cylindrical or have another shape and be more or less rigid. The sealing or closing means 16 may be of another type than shown. The container 1 may consist of flexible walls in its entirety and be of the plastic bag-type, but it may also be designed otherwise and only partly consist of flexible walls.

A discharge or outfeed device 25, schematically illustrated in FIG. 1, can be connectable to the sealable member 14 of the tube member 12 when it is open and said discharge or outfeed device 25 may include a flexible tube with a valve or a manually operable tap or similar.

In the tube member 12 there may be provided a wall with an opening having a particular unround shape such that a string discharged or fed out through the tube member 12 will get a special cross sectional shape. This shape may e.g. be star-like.

What is claimed is:

1. Device for opening and closing containers having flexible walls and containing a liquid or semi-liquid product, preferably foodstuff such as e.g. ketchup, mustard, dressing, mayonnaise or similar, said container (1) comprising an inner coupling member (4) which is located on the inner side of a sealed or closed portion of the flexible walls (2), and said device comprising a tube member (12) including a hole-making and coupling member (13) which is adapted to be pressed through the closed portion of the flexible walls (2) for opening thereof as well as adapted to be pressed on to said inner coupling member (4) such that said tube member (12) is fixedly attached thereto and the product (3) can be discharged or fed out of the container (1) through the tube member (12), characterized in that the tube member (12) further includes a sealable member (14) which is adapted to be sealed or closed by means of a sealing or closing means (16) such that a container (1) opened by the tube member (12) can be closed again, and that the sealing or closing means (16) is connected with the tube member (12) or with a member (17) associated therewith.

2. Device according to claim 1, characterized in that the tube member (12) and the sealing or closing means (16) is a one piece member.

3. Device according to claim 1, characterized in that the sealing or closing means (16) is connected with the tube member (12) or with a member (17) associated therewith such that it can be moved from a rest position (A) in which it does not seal or close the sealable member (14) of the tube member (12), to a sealing or closing position (B) in which it closes said sealable member (14).

4. Device according to claim 3, characterized in that the sealing or closing means (16) is provided on the tube member (12) or on the member (17) associated therewith through a retaining member (18) having a joint or hinge (19) which permits manual swinging or pivoting of said sealing or closing means (16) from the rest position (A) to the sealing or closing position (B).

5. Device according to claim 4, characterized in that the hinge or joint (19) is provided to guide the sealing or closing means (16) in a direction (arrow C) towards the sealing or closing position (B) when said sealing or closing means (16) is moved from the rest position (A) in a direction towards the sealable member (14).

6. Device according to claim 1, characterized in that the sealing or closing means (16) by means of a snap-in closure can be attached to the sealable member (14) of the tube member (12).

7. Device according to claim 6, characterized in that the sealing or closing means (16) includes a cylindrical snap-in merger (22) with an internal snap-in portion (23) and that said snap-in member (22) can be attached by a snap-in closure to the sealable member (14) by attaching by said snap-in closure the internal snap-in portion (23) thereof to an external snap-in portion (24) on said sealable member (14).

8. Device according to claim 6, characterized in that the sealing or closing means (16) includes a pressure plate (21) against which the thumb can be pressed for attaching by a snap-in closure said sealing or closing means (16) to the sealable member (14).

9. Device according to claim 1, characterized in that the sealing or closing means (16) and the sealable member (14) are shaped or designed such that said sealing or closing means (16) closes said sealable member (14) with an air-tight seal.

10. Device according to claim 1, characterized in that the tube member (12) has a transverse collar (17) with the sealing or closing means (16) provided thereon.

11. Device according to claim 1, characterized in that the tube member (12) and the sealing or closing means (16) are formed in one piece of polypropylene material.

12. Device according to claim 1, characterized in that the container (1) is compressible for discharge or outfeed of the product (3) therefrom through the tube member (12).

13. Device according to claim 1, characterized in that a discharge or outfeed device (25) for discharge or outfeed of product (3) flowing through the tube member (12), can be connected to the sealable member (14) of the tube member (12) when said sealable member (14) is open.

14. Device according to claim 1, characterized in that the inner coupling member (4) consists of an outer ring (5) through which it is provided on the inner side of the flexible walls (2) and which has a hole (15) in which the hole-making and coupling member (13) of the tube member (12) can be inserted, that the inner coupling member (4) further consists of an inner ring (6) which preferably has a larger outer diameter than the outer ring (5) and that the outer and inner rings (5, 6) are connected with each other through at least two connecting members (7, 8) between which openings (9, 10) are provided.

* * * * *